US008542159B2

(12) United States Patent
Taguchi

(10) Patent No.: US 8,542,159 B2
(45) Date of Patent: Sep. 24, 2013

(54) CABLE CONNECTOR AND ANTENNA COMPONENT

(75) Inventor: Hiroyuki Taguchi, Tokyo (JP)

(73) Assignee: Fujikura Ltd., Tokyo (JP)

( * ) Notice: Subject to any disclaimer, the term of this patent is extended or adjusted under 35 U.S.C. 154(b) by 251 days.

(21) Appl. No.: 13/158,774

(22) Filed: Jun. 13, 2011

(65) Prior Publication Data

US 2011/0234473 A1 Sep. 29, 2011

Related U.S. Application Data

(63) Continuation of application No. PCT/JP2009/006942, filed on Dec. 16, 2009.

(30) Foreign Application Priority Data

Dec. 16, 2008 (JP) ..... 2008-319520
Dec. 16, 2008 (JP) ..... 2008-319946

(51) Int. Cl.
*H01Q 1/50* (2006.01)

(52) U.S. Cl.
USPC ..... 343/906; 343/702; 439/916

(58) Field of Classification Search
USPC ..... 343/702, 906, 904, 905; 439/916
See application file for complete search history.

(56) References Cited

U.S. PATENT DOCUMENTS

| | | | | |
|---|---|---|---|---|
| 2003/0064622 | A1* | 4/2003 | Brown et al. | 439/405 |
| 2003/0176109 | A1* | 9/2003 | Fukuchi et al. | 439/638 |
| 2005/0196985 | A1* | 9/2005 | Behn et al. | 439/76.1 |
| 2006/0141811 | A1* | 6/2006 | Shichida et al. | 439/63 |
| 2008/0122705 | A1* | 5/2008 | Kurashima et al. | 343/702 |

FOREIGN PATENT DOCUMENTS

| | | | |
|---|---|---|---|
| CN | 201039143 | Y | 3/2008 |
| JP | 2-31080 | U | 2/1990 |
| JP | 2001-307842 | A | 11/2001 |
| JP | 2006-216445 | A | 8/2006 |
| JP | 2006-318936 | A | 11/2006 |
| JP | 2008-226588 | A | 9/2008 |

OTHER PUBLICATIONS

Office Action issued by Chinese Patent Office in Chinese Application No. 200980149796.4 dated May 6, 2013.

* cited by examiner

*Primary Examiner* — Hoanganh Le
(74) *Attorney, Agent, or Firm* — Sughrue Mion, PLLC

(57) ABSTRACT

Provided is a cable connector of the present invention includes: a wiring board with a signal transmission line; and a plug connector that is provided on one surface of the wiring board and that is electrically connected with the signal transmission line. The wiring board comprises a first conductor, an insulating material, and a second conductor laminated in this order. In a slit formed in the second conductor, the signal transmission line that is a part of the second conductor cut out from the second conductor is arranged at a predetermined distance from the second conductor. The second conductor and the signal transmission line are arranged on the same plane.

14 Claims, 13 Drawing Sheets

CABLE CONNECTOR AND ANTENNA COMPONENT

CROSS-REFERENCE TO RELATED APPLICATION

This is a Continuation Application of International Application No. PCT/JP2009/006942, filed on Dec. 16, 2009, which claims priority to Japanese Patent Application No. 2008-319520, filed on Dec. 16, 2008, and Japanese Patent Application No. 2008-319946, filed on Dec. 16, 2008. The contents of the aforementioned applications are incorporated herein by reference.

BACKGROUND OF THE INVENTION

1. Field of the Invention

The present invention relates to a cable connector for connecting an RF module with an antenna in the internal components of electronic equipment, and also relates to an antenna component in which the cable connector is connected with the antenna. More particularly, the present invention relates to a cable connector and an antenna component which eliminate complicated steps of assembling a connector with a transmission line, which are capable of reducing assembly steps in number and a manufacturing cost more than the conventional cable connectors and antenna components, and which are capable of making a connector connection portion thinner.

2. Description of the Related Art

In conventional RF connectors (small-size coaxial connectors), electrically connecting a coaxial cable with an RF module in a method as shown, for example, in FIG. 11A to FIG. 13 is dominant (for example, see Japanese Unexamined Patent Application, First Publication No. 2001-307842 and Japanese Unexamined Patent Application, First Publication No. 2006-318936). In this method, a coaxial cable 141 is first stripped as shown in FIGS. 11A and 11B to expose an internal conductor 142 and an external conductor 143. Next, as shown in FIG. 11D, the internal conductor 142 of the coaxial cable 141 is soldered to a contact terminal 140 as shown in FIG. 11C. Next, as shown in FIG. 12A, a housing 122 is assembled into a shell terminal 121 to fabricate an assembly 120. Next, as shown in FIG. 12B, into the assembly 120, the coaxial cable 141 soldered to the contact terminal 140 is assembled. Next, as shown in FIGS. 12C and 12D, the external conductor 143 of the coaxial cable 141 is caulked into the shell terminal 121, and also an outer cladding 144 of the coaxial cable 141 is caulked into the shell terminal 121. The assembly 120 connected with the coaxial cable 141 is attached to an RF module 130 as shown in FIG. 13, to thereby electrically connect the coaxial cable 141 with the RF module 130.

However, in the case where a conventional RF connector is used, the number of assembly steps is large as shown in FIGS. 11A to 12D. In addition, the assembly requires a sophisticated skill.

Furthermore, because the coaxial cable has a large diameter, it is difficult to make thin (low-profile) the connection portion (the connector connection portion) between the coaxial cable and the RF connector (that is, make thin the assembly 120 shown in FIG. 12D).

Furthermore, with numerous steps for assembling the RF connector with the coaxial cable, their manufacturing cost becomes high.

The present invention has been achieved in view of the above circumstances, and has an object to provide a cable connector and an antenna component with a reduced number of assembly steps and a reduced manufacturing cost, and also capable of making the connector connection portion thin.

SUMMARY

To solve the above problems and achieve such an object, the present invention adopts the followings.

(1) A cable connector of the present invention includes: a wiring board with a signal transmission line; and a plug connector that is provided on one surface of the wiring board and that is electrically connected with the signal transmission line. The wiring board comprises a first conductor, an insulating material, and a second conductor laminated in this order. In a slit formed in the second conductor, the signal transmission line that is a part of the second conductor cut out from the second conductor is arranged at a predetermined distance from the second conductor. The second conductor and the signal transmission line are arranged on the same plane.

(2) In the case of the above (1), it is preferable that the wiring board comprises the first conductor, the second conductor, and the third conductor laminated in this order respectively via an insulating material.

(3) In the case of the above (1) or (2), it is preferable that on the one surface of the wiring board, a coaxial cable that is electrically connected with the signal transmission line be disposed.

(4) In the case of the above (1) or (2), it is preferable that a first notch portion be formed at a position facing the signal transmission line of the first conductor.

(5) In the case of the above (4), it is preferable that a second notch portion be formed at a position facing the plug connector of the first conductor.

(6) An antenna component of the present invention includes: a first wiring board with a signal transmission line; a plug connector that is provided on one surface of the first wiring board and that is electrically connected with the signal transmission line; and a second wiring board that has an antenna electrically connected with the signal transmission line and that is coupled to the first wiring board. The first wiring board comprises a first conductor, an insulating material, and a second conductor laminated in this order. In a slit formed in the second conductor, the signal transmission line that is a part of the second conductor cut out from the second conductor is arranged at a predetermined distance from the second conductor. The second conductor and the signal transmission line are arranged on the same plane.

(7) In the case of the above (6), it is preferable that the first wiring board comprises the first conductor, the second conductor, and the third conductor laminated respectively via an insulating material.

(8) In the case of the above (6) or (7), it is preferable that a first notch portion is formed at a position facing the signal transmission line of the first conductor.

(9) In the case of the above (8), it is preferable that a second notch portion is formed at a position facing the plug connector of the first conductor.

According to the cable connector as set forth in the above (1), the second conductor and the signal transmission line are placed on the same plane, and the second conductor is placed on both sides of the signal transmission line. This can make the connection portion between the plug connector and its mating connector thin. Therefore, it is possible to make thin the electronic equipment that uses the cable connector.

Furthermore, the plug connector can be installed on the wiring board with ease, which makes it possible to simplify the assembly steps. As a result, the manufacturing cost of the cable connector can be reduced. Furthermore, because the assembly steps can be simplified, the manufactured cable connectors are unlikely to suffer from performance variations, making it possible to provide stable products.

In addition, with the change such as in width and length of the signal transmission line, in a gap between the signal transmission line and the second conductor, and in thickness of the first conductor and the second conductor, it is possible to control the characteristic impedance of the signal transmission line with ease. Therefore, impedance of the wiring board can be optimized with ease in accordance with the communication characteristics (frequency band, communication distance, and the like) at high frequencies of the equipment and the antenna that are to be connected with the cable connector.

According to the antenna component as set forth in the above (6), it is possible to make thin the connection portion between the plug connector and its mating connector, the connection portion between the first wiring board and the second wiring board, and the antenna. Therefore, it is possible to make thin the electronic equipment that uses the antenna component.

Furthermore, the plug connector can be installed on the first wiring board with ease, which makes it possible to simplify the assembly steps. As a result, the manufacturing cost of the antenna component can be reduced. Furthermore, because the assembly steps can be simplified, the manufactured antenna components are unlikely to suffer from performance variations, making it possible to provide stable products.

In addition, with the change in width and length of the signal transmission line, in a gap between the signal transmission line and the second conductor, and in thickness of the first conductor and the second conductor, it is possible to control the characteristic impedance of the signal transmission line. Therefore, impedance of the first wiring board can be optimized with ease in accordance with the communication characteristics (frequency band, communication distance, and the like) at high frequencies of the antenna of the second wiring board.

EMBODIMENTS FOR CARRYING OUT THE INVENTION

Embodiments of a cable connector according to the present invention will be described.

The embodiments will be specifically described for better understanding of the spirit or scope of the invention, and hence, do not limit the present invention unless otherwise specified.

First Embodiment

Figure 1A:
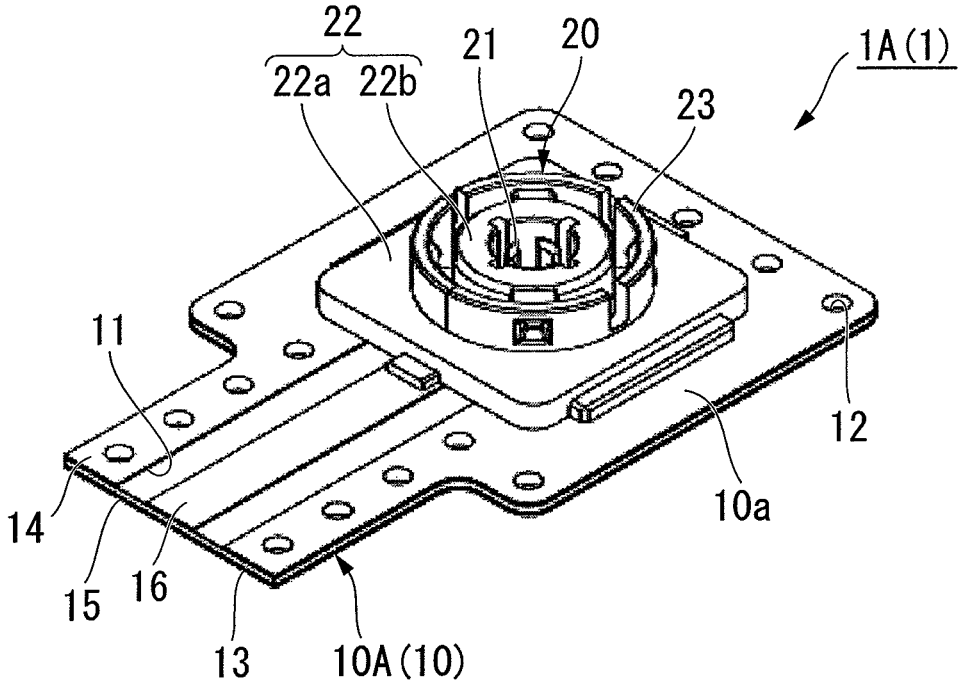
FIG. 1A is a perspective view showing a first embodiment of a cable connector according to the present invention.
Figure 1B:
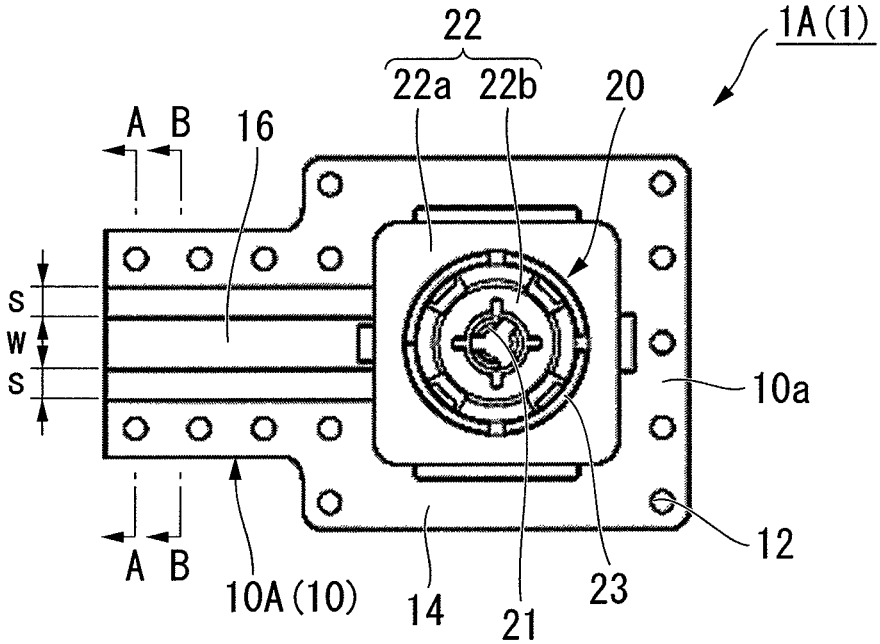
FIG. 1B is a plan view of the embodiment.
Figure 1C:
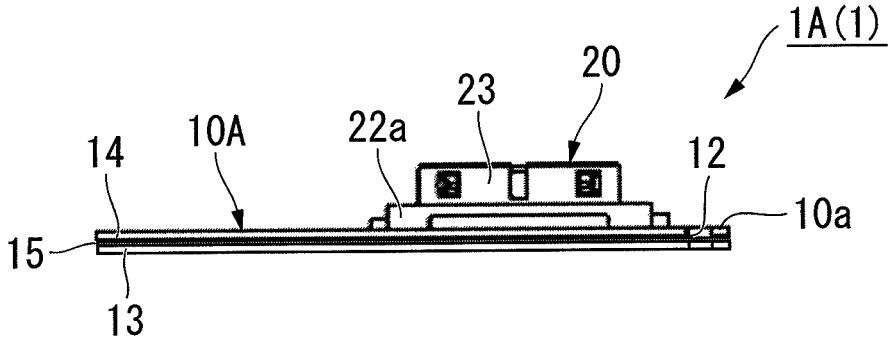
FIG. 1C is a side view of the embodiment.
Figure 1D:
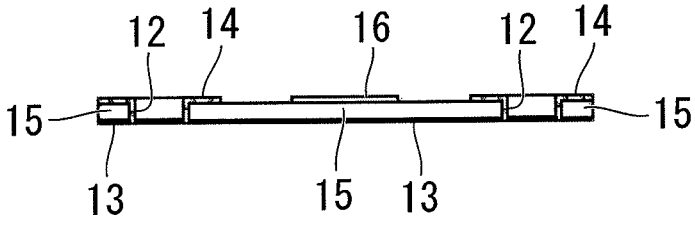
FIG. 1D is a cross-sectional view of FIG. 1B, taken along the A-A line.
Figure 1E:
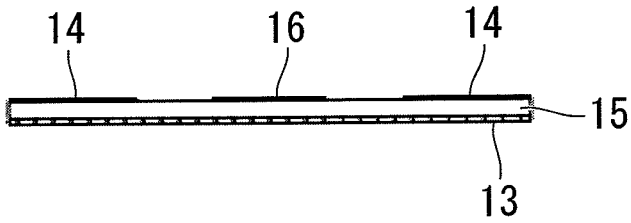
FIG. 1E is a cross-sectional view of FIG. 1B, taken along the B-B line.

FIGS. 1A to 1E are schematic diagrams showing a first embodiment of a cable connector according to the present invention. FIG. 1A is a perspective view of the present embodiment. FIG. 1B is a plan view of the present embodiment. FIG. 1C is a side view of the present embodiment. FIG. 1D is a cross-sectional view of FIG. 1B, taken along the A-A line. FIG. 1E is a cross-sectional view of FIG. 1B, taken along the B-B line.

A cable connector 1A (1) of the present embodiment comprises: a wiring board 10A (10); and a plug connector 20.

The wiring board 10A has a first conductor 13, an insulating material 15, and a second conductor 14, which are laminated in this order with a substantially equal thickness. As the insulating material 15, for example a polyimide resin, a polyethylene terephthalate resin, an aramid resin, a liquid crystal polymer (LCP), or the like may be used.

In the second conductor 14, a part of it is cut off to form a slit 11. In the slit 11, a signal transmission line 16, which is made of the same material as that of the second conductor 14, is arranged with a predetermined space s from the second conductor 14 (see FIG. 2A). The second conductor 14 and the signal transmission line 16 are placed on the same plane. That is, the signal transmission line 16 is placed so that its two sides and its front end side (plug connector 20 side) is surrounded by the second conductor 14.

A plug connector 20 is provided on one surface 10*a* of the wiring board 10, and is electrically connected with the signal transmission line 16.

In the cable connector 1A of the present embodiment, the first conductor 13 and the second conductor 14 form ground conductor for the signal transmission line 16. That is, in the wiring board 10A, the signal transmission line 16 is arranged so as to be on a wide ground conductor (the first conductor 13), and another ground conductor (the second conductor 14) is arranged on the same plane as the signal transmission line 16 so as to surround the two sides and the front end side of the signal transmission line 16. With this construction, the radiated noise from the signal transmission line 16 is diminished.

Figure 2A:
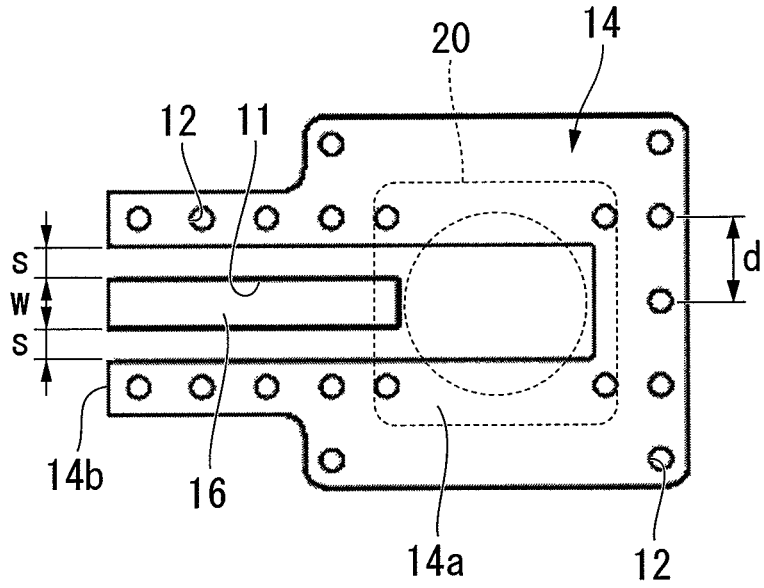
FIG. 2A is a plan view of a second conductor used in the embodiment.

FIG. 2A is a plan view schematically showing the second conductor 14 and the signal transmission line 16.

The second conductor 14 and the signal transmission line 16 are made of a foil of metal such as copper.

As shown in FIG. 2A, the signal transmission line 16 is provided in the longitudinal direction of the second conductor 14, along the slit 11 provided in the central portion of the second conductor 14. The signal transmission line 16 has its base end in the vicinity of an end portion of a region 14*a* of the second conductor 14 that faces the plug connector 20. The signal transmission line 16 extends as far as to one end 14*b* of the second conductor 14. The signal transmission line 16 is electrically connected with, for example, an antenna or the like at the one end portion 14*b* of the second conductor 14 (not shown in the figure).

Furthermore, the signal transmission line 16 is arranged at a predetermined space s from the second conductor 14.

Figure 2B:
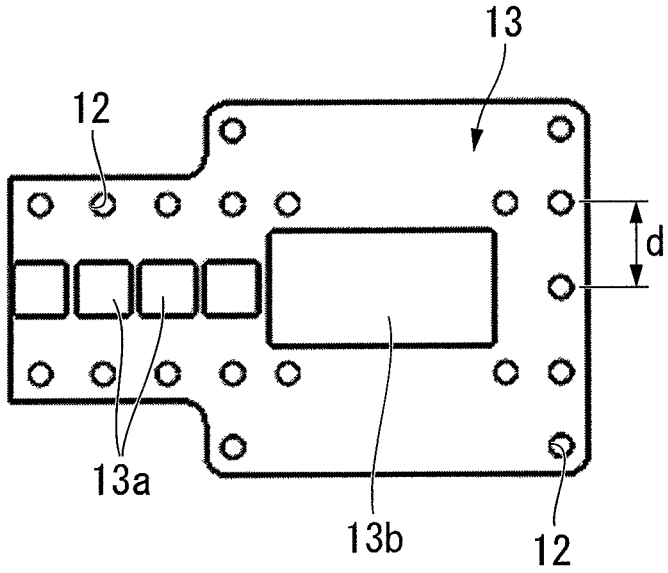
FIG. 2B is a plan view of a first conductor used in the embodiment.

FIG. 2B is a plan view schematically showing the first conductor 13.

The first conductor 13 is made of a foil of metal such as copper, similarly to the second conductor 14 and the signal transmission line 16.

In the first conductor 13, there are formed a plurality of rectangular first notch portions 13*a* at positions facing the signal transmission line 16. Furthermore, at a position of the first conductor 13 that faces the plug connector 20, there is formed a second notch portion 13*b* that is larger than the first notch portion 13*a*. With the first notch portions 13*a* and the second notch portion 13*b* formed at these positions, impedance matching of the wiring board 10A can be obtained, reflection loss of the electric signals are diminished, and transmission characteristics of the signals flowing through the signal transmission line 16 can be improved. Without the first notch portions 13*a* and the second notch portion 13*b*, there is a possibility that use of a thin substrate such as an FPC will cause the C component increase and its impedance decrease, resulting in insufficient transmission of signals.

The first notch portion 13*a* has a size of, for example, 0.5 mm×0.5 mm.

The second notch portion 13*b* has a size of, for example, 2.1 mm×1.05 mm.

Along the edge portions of the first conductor 13 and the second conductor 14, and along the edge portion of the insulating material 15 that is placed therebetween, there are provided a plurality of through-holes 12 at their respective corresponding positions, which are spaced a predetermined distance apart from each other. That is, the through-holes 12 penetrate the wiring board 10A (10) in its thickness direction to electrically connect the first conductor 13 with the second conductor 14.

The distance d between the through-holes 12 is a length corresponding to ½ or less of the wavelength of the frequency of the antenna to be connected with the cable connector 1A.

The space s between the second conductor 14 and the signal transmission line 16, the length and the width w of the signal transmission line 16, the thicknesses of the first conductor 13, the second conductor 14, and the insulating material 15, and other dimensions are appropriately adjusted in accordance with the impedance required for the wiring board 10A. As a result, impedance of the wiring board 10A can be adjusted, and also the impedance can be optimized in accordance with the communication characteristics (frequency band, communication distance, and the like) at high frequencies of the antenna to be connected with the cable connector 1A.

For example, in portable communication equipment on a radio system that communicates in the 12 GHz band, the impedance required for the wiring board 10A is 50Ω. Therefore, for example, the space s between the second conductor 14 and the signal transmission line 16 is set to 200 μm, the length of the signal transmission line 16 is set to 20 mm or less, the width w of the signal transmission line 16 is set to 450 μm, the thickness of the first conductor 13 is set to 18 μm, the thickness of the second conductor 14 is set to 18 μm, and the thickness of the insulating material 15 is set to 70 μm. Thereby, a wiring board 10A with an impedance of 50Ω is obtained.

The plug connector 20 comprises: a contact terminal 21; an insulator 22; and an external conductor 23.

The contact terminal 21 is brought into contact with a contact portion of a mating connector (a receptacle connector), to thereby be electrically connected with the receptacle connector. In addition, the contact terminal 21 is electrically connected with the signal transmission line 16. That is, the signal transmission line 16 is to be electrically connected with the contact portion of the receptacle connector via the contact terminal 21.

The insulator 22 comprises: a flat plate portion 22*a*; and a bump portion 22*b* formed on one surface of the flat plate portion 22*a*. The bump portion 22*b* supports the contact terminal 21 as if surrounding the contact terminal 21. The plug connector 20 is arranged on the one surface 10*a* of the wiring board 10 via the flat plate portion 22*a* of the insulator 22. The insulator 22 is made of, for example, a liquid crystal polymer (LCP).

The external conductor 23 is arranged so as to surround the bump portion 22*b* of the insulator 22 from its outer circumference, and is electrically connected with the first conductor 13 and the second conductor 14.

Figure 3:
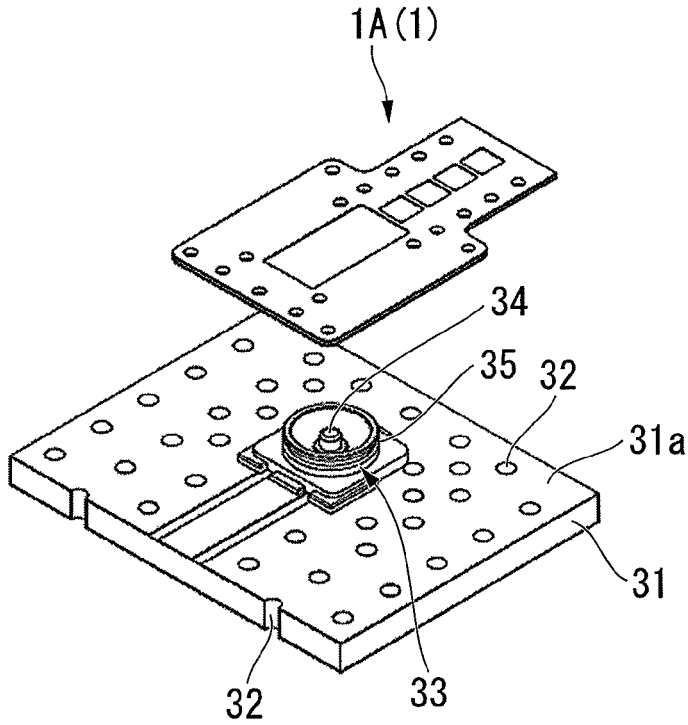
FIG. 3 is a schematic perspective view showing one example of use of the cable connector of the embodiment.

When the cable connector 1A of the present embodiment is used, the plug connector 20 of the present embodiment is connected with a receptacle connector 33 provided on one surface 31*a* of the insulating substrate 31, as shown in FIG. 3. More particularly, a contact terminal 34 of the receptacle connector 33 is fitted into the contact terminal 21 of the plug connector 20, and also an external conductor 35 of the receptacle connector 33 is fitted into the external conductor 23 of the plug connector 20. Thereby, each pair is electrically connected. It is preferable that through-holes 32 be provided in the insulating substrate 31 similarly to the wiring board 10A of the present embodiment. At this time, the distance between the through-holes 32 is a length corresponding to ½ or less of the wavelength of the frequency of the antenna to be connected with the cable connector 1A, similarly to the case of the through-holes 12 provided in the wiring board 10A.

According to the cable connector 1A of the present embodiment, the aforementioned wiring board 10A is used instead of a conventional coaxial cable. This eliminates the necessity of taking the outer diameter of the coaxial cable into consideration. Hence, the thickness of the connection portion between the plug connector 20 and the receptacle connector 33 can be made thin. Therefore, it is possible to make thin the electronic equipment that uses the cable connector 1A of the present embodiment.

Furthermore, impedance of the wiring board 10A can be adjusted, and also the impedance can be optimized in accordance with the communication characteristics (frequency band, communication distance, and the like) at high frequencies of the antenna to be connected with the cable connector 1A.

Furthermore, if the plug connector 20 is installed at a predetermined position of the wiring board 10A, the cable connector 1A of the present embodiment is obtained. Therefore, this can be assembled more easily than conventional RF connectors, thus making it possible to simplify the assembly steps. That is, with reference to FIG. 11A to FIG. 12D, the conventionally required steps include: stripping the coaxial cable 141; connecting the coaxial cable 141 with the contact terminal 140; fabricating the assembly 120; assembling the assembly 120 into the coaxial cable 141; caulking the external conductor 143 of the coaxial cable 141 into the shell terminal 121; and caulking the outer cladding 144 of the coaxial cable 141 into the shell terminal 121. On the other hand, according to the present embodiment, it is only required that the first conductor 13, the insulating material 15, and the second conductor 14 and the signal transmission line 16 be laminated (in a batch) to fabricate the wiring board 10A, and then that the plug connector 20 be installed at a predetermined position of the wiring board 10. This makes it possible to assemble the cable connector 1A more easily than ever. As a result, special devices and jigs required for the assembly become unnecessary. Therefore, the manufacturing cost of the cable connector 1A can be reduced. In addition, the manufactured cable connectors 1A are unlikely to suffer from performance variations, making it possible to provide stable products.

Second Embodiment

Figure 4:
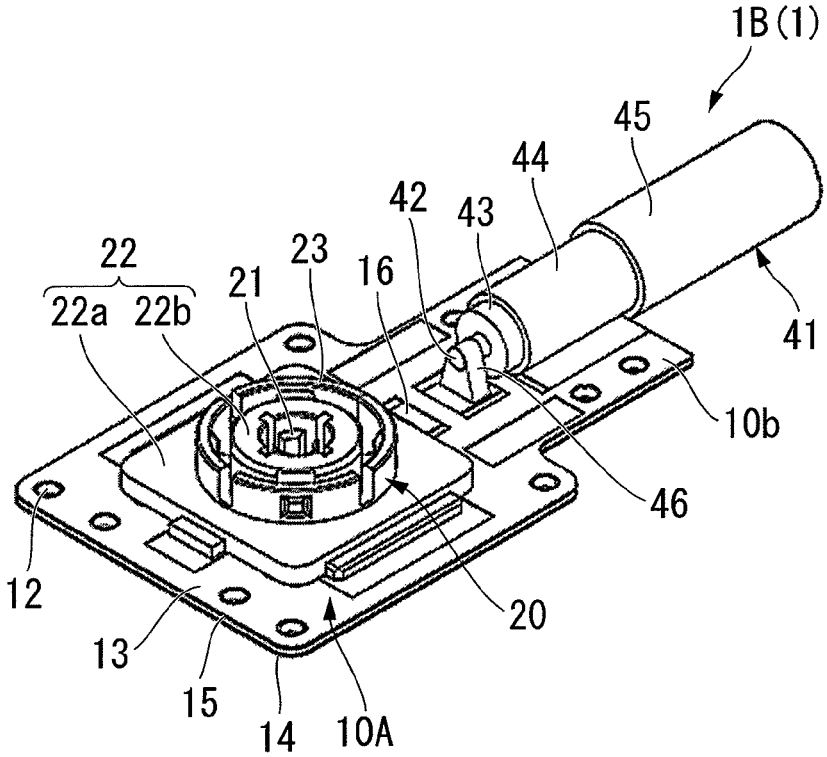
FIG. 4 is a schematic perspective view showing a second embodiment of the cable connector according to the present invention.

FIG. 4 is a schematic perspective view showing a second embodiment of the cable connector according to the present invention.

In FIG. 4, like constituent parts to those of the first embodiment shown in FIGS. 1A to 2B are designated with same reference numerals and are not repetitiously explained.

A cable connector 1B (1) of the present embodiment is different from the aforementioned cable connector 1A (1) of the first embodiment in that a plug connector 20 is provided on one surface (the other surface 10*b* of the wiring board 10A) of a first conductor 13, and in that a coaxial cable 41, which is electrically connected with a signal transmission line 16, is disposed on the one surface of the first conductor 13 at one end portion of the wiring board 10A.

The coaxial cable 41 comprises: a central conductor 42 composed of a single-core line, a twisted line, or the like; an insulator 43 that covers the outer circumference thereof; an external conductor 44 that is coaxially placed outside the insulator 43; and an outer cladding 45 that covers the outside of the external conductor 44.

The coaxial cable 41 is arranged on the one surface of the first conductor 13 that constitutes the wiring board 10A, with its central conductor 42 being exposed. The central conductor 42 is electrically connected with the signal transmission line 16 via, for example, a conducting member 46. The conducting member 46 is arranged in a first notch portion 13*a* formed in the first conductor 13. The conducting member 46 is not particularly limited so long as it is capable of electrically connecting the central conductor 42 with the signal transmission line 16. It may be a metal foil, a solder, a conductive adhesive, or the like.

Furthermore, the external conductor 44 of the coaxial cable 41 is electrically connected with the first conductor 13.

According to the cable connector 1B of the present embodiment, similar advantages to those of the aforementioned first embodiment are obtained. In the present embodiment, the coaxial cable 41 is connected with the wiring board 10A. To be more specific, the coaxial cable 41 is spaced from the plug connector 20, and is electrically connected with the plug connector 20 via the signal transmission line 16. Therefore, the thickness of the connection portion between the cable connector 1B and the receptacle connector 33 of the present embodiment is equal to the total thickness of the wiring board 10A and the plug connector 20, similarly to the case of the first embodiment. Consequently, it is possible to make the thickness of the connection portion thinner than ever.

Furthermore, in the cable connector 1B of the present embodiment, the coaxial cable 41 which is electrically connected with the signal transmission line 16 is disposed on the other surface 10*b* (the one surface of the first conductor 13) of the wiring board 10A. Therefore, it is possible to route the signal transmission line (the coaxial cable 41) in the housing of the electronic equipment in a more complex manner over a longer distance than the case of the first embodiment. Consequently, with the signal transmission line (the coaxial cable 41) excellent in high-frequency characteristics being routed, it is possible to suppress deterioration of the communication characteristics at high frequencies.

Third Embodiment

Figure 5A:
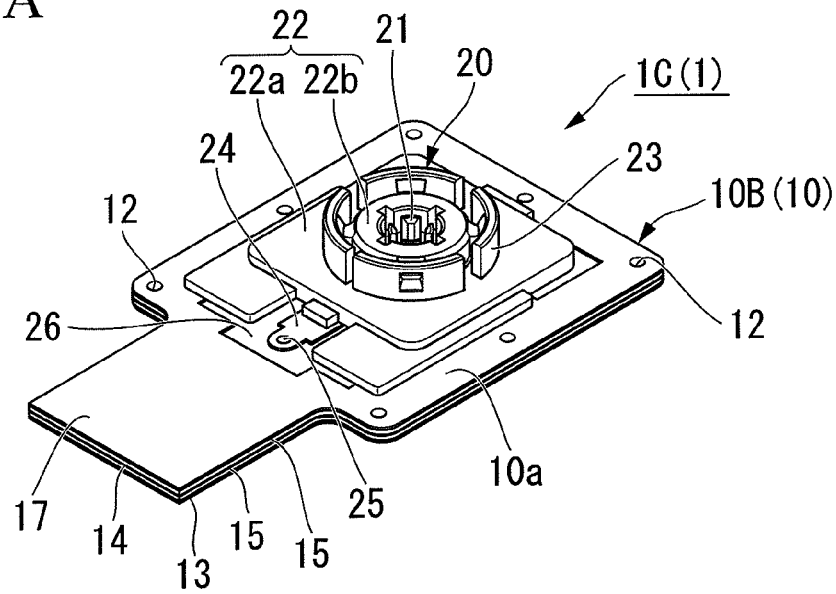
FIG. 5A is a perspective view showing a third embodiment of the cable connector according to the present invention.
Figure 5B:
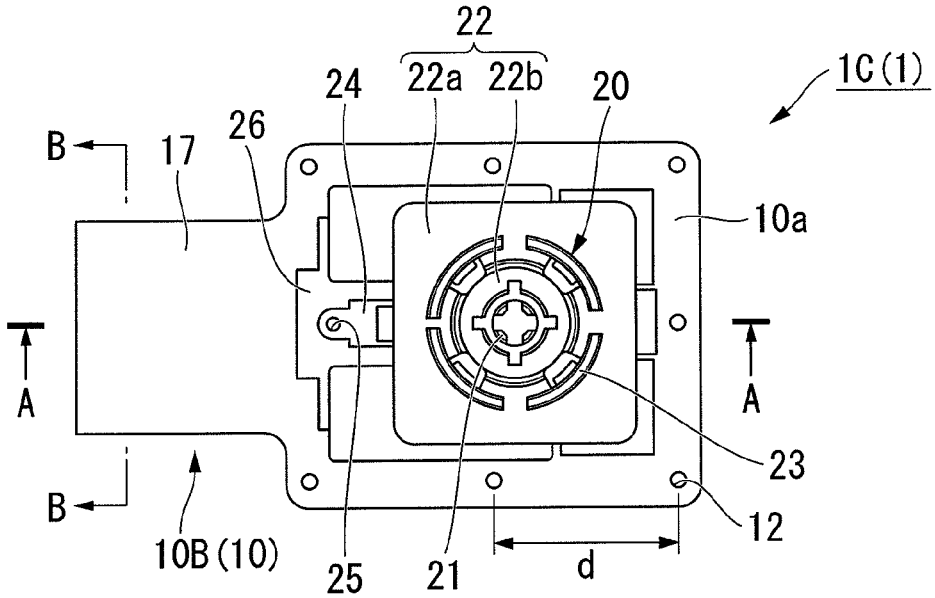
FIG. 5B is a plan view of the embodiment.
Figure 5C:
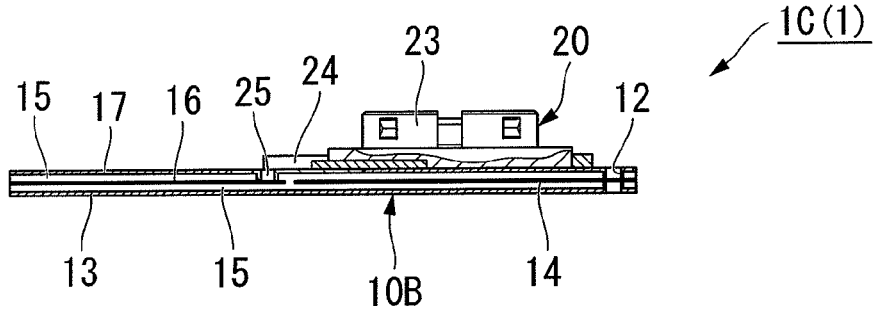
FIG. 5C is a cross-sectional view of FIG. 5B, taken along the A-A line.
Figure 5D:
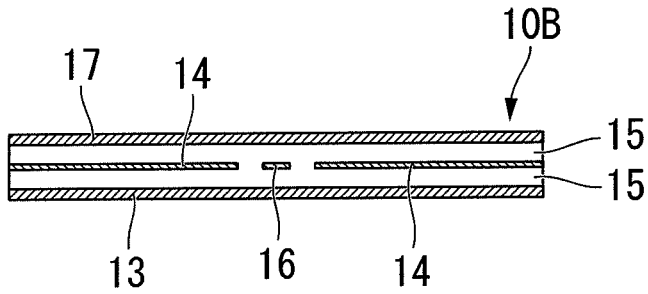
FIG. 5D is a cross-sectional view of FIG. 5B, taken along the B-B line.

FIGS. 5A to 5D are schematic diagrams showing a third embodiment of the cable connector according to the present invention. FIG. 5A is a perspective view of the present embodiment. FIG. 5B is a plan view of the present embodiment. FIG. 5C is a cross-sectional view of FIG. 5B, taken along the A-A line. FIG. 5D is a cross-sectional view of FIG. 5B, taken along the B-B line.

In FIGS. 5A to 5D, like constituent parts to those of the aforementioned first embodiment are designated with same reference numerals and are not repetitiously explained.

A cable connector 1C (1) of the present embodiment is different from the aforementioned cable connector 1A (1) of the first embodiment in that a wiring board 10B (10) comprises a first conductor 13, a second conductor 14, and a third conductor 17 laminated in this order respectively via an insulating material 15. The first conductor 13, the second conductor 14, and the third conductor 17 are electrically connected via through-holes 12 which are formed along the edge portion of the wiring board 10B. Also in the present embodiment, a distance d between the through-holes 12 is a length corresponding to ½ or less of the wavelength of the frequency of the antenna to be connected with the cable connector 1C.

The third conductor 17 is made of, for example, a foil of metal such as copper, similarly to the first conductor 13 and the second conductor 14.

On one surface of the third conductor 17 (the one surface 10*a* of the wiring board 10B), there is provided a first conductive portion 24 at a position corresponding to a signal transmission line 16 via an insulating film 26. On the first conductive portion 24, there is placed a plug connector 20. The first conductive portion 24 is electrically connected with a contact terminal 21 of the plug connector 20 via a conductive portion (not shown in the figures) that extends through an insulator 22 of the plug connector 20.

Furthermore, the first conductive portion 24 is electrically connected with the signal transmission line 16 via a second conductive portion 25 that extends through the third conductor 17, the insulating film 26, and the insulating material 15.

Furthermore, the external conductor 23 is electrically connected with the third conductor 17.

Figure 6:
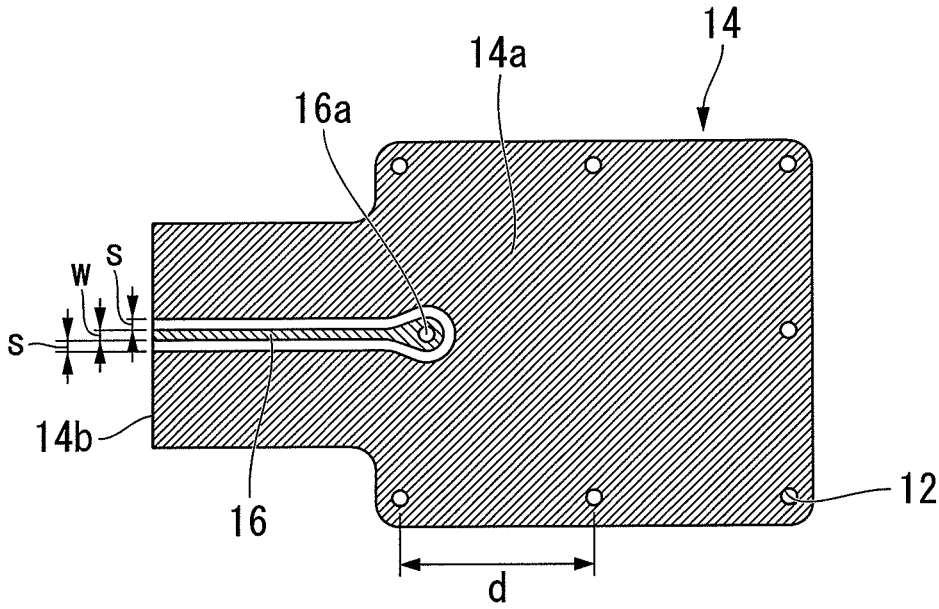
FIG. 6 is a plan view showing an arrangement of a second conductor and a signal transmission line of the embodiment.

FIG. 6 is a plan view schematically showing the second conductor 14 and the signal transmission line 16 of the present embodiment. Also in the present embodiment, the signal transmission line 16 is provided in the longitudinal direction of the second conductor 14, along the slit 11 provided in the central portion of the second conductor 14, similarly to the aforementioned first embodiment. At this time, the signal transmission line 16 is arranged with a predetermined space s from the second conductor 14.

In the vicinity of the end portion on the plug connector 20 side of the signal transmission line 16, there is provided a through-hole 16*a*. With a second conductive portion 25 being arranged in the through-hole 16*a*, the signal transmission line 16 and the first conductive portion 24 are electrically connected with each other.

As for the cable connector 1C of the present embodiment, for example in portable communication equipment on a radio system that communicates in the 12 GHz band, impedance required for the wiring board 10B is 50Ω. Therefore, the space s between the second conductor 14 and the signal transmission line 16 is set to 100 μm, the length of the signal transmission line 16 is set to 50 mm or less, the width w of the signal transmission line 16 is set to 85 μm, the thickness of the first conductor 13 is set to 18 μm, the thickness of the second conductor 14 is set to 18 μm, the thickness of the third conductor 17 is set to 18 μm, the thickness of the insulating material 15 placed between the second conductor 14 and the third conductor 17 is set to 70 μm, the thickness of the insulating material 15 placed between the first conductor 13 and the second conductor 14 is set to 67 μm.

Also in the present embodiment, it is preferable that first notch portions be provided at positions facing the signal transmission line 16 of the first conductor 13 and that a second notch portion be provided at a position facing the plug connector 20 of the first conductor 13 (not shown in the figures), similarly to the aforementioned first embodiment. Furthermore, similarly to the third conductor 17, it is preferable that the first notch portions be provided at positions facing the signal transmission line 16 of the third conductor 17 and that the second notch portion be provided at a position facing the plug connector 20 of the third conductor 17 (not shown in the figures). With the first notch portions and the second notch portion being provided, impedance matching of the wiring board 10B can be obtained, reflection loss of the electric signals is diminished, and transmission characteristics of the signals flowing through the signal transmission line 16 can be improved. Without the first notch portions and the second notch portion, there is a possibility that use of a thin substrate such as an FPC will cause the C component increase and its impedance decrease, resulting in insufficient transmission of signals.

Figure 7:
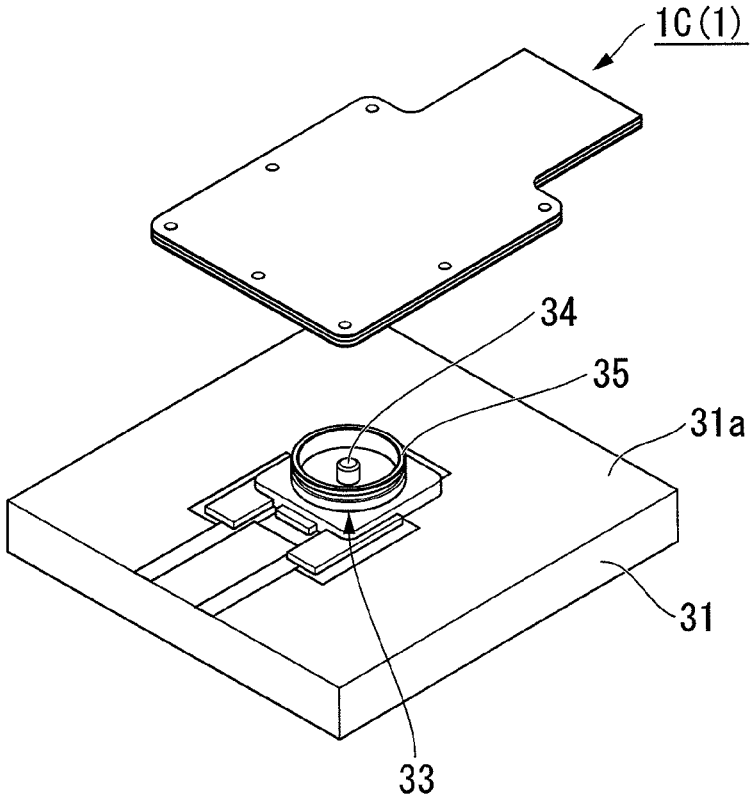
FIG. 7 is a schematic perspective view showing one example of use of the cable connector of the embodiment.

FIG. 7 is a perspective view showing an example of use of the cable connector 1C of the present embodiment. Similarly to the first embodiment, when the cable connector 1C of the present embodiment is used, the plug connector 20 of the present embodiment is connected to a receptacle connector 33 provided on one surface 31*a* of an insulating substrate 31. More particularly, a contact terminal 34 of the receptacle connector 33 is fitted into the contact terminal 21 of the plug connector 20, and also an external conductor 35 of the receptacle connector 33 is fitted into the external conductor 23 of the plug connector 20. Thereby, each pair is electrically connected.

FIG. 7 illustrates an insulating substrate 31 with a construction without through-holes. However, the insulating substrate 31 may be provided with through-holes, similarly to the case of the first embodiment. At this time, the distance between the through-holes is a length corresponding to ½ or less of the wavelength of the frequency of the antenna to be connected with the cable connector 1C.

According to the cable connector 1C of the present embodiment, similar advantages to those of the aforementioned first embodiment are obtained. At this time, in the present embodiment, the connection portion between the plug connector 20 and the receptacle connector 33 is thicker than that of the first embodiment by the total thickness of the third conductor 13 and one layer of the insulating material 15 because the wiring board 10 comprises the first conductor 13, the second conductor 14, the third conductor 17, and the insulating materials 15 arranged therebetween. However, compared with the case where a conventional coaxial cable is used, the connection portion is still sufficiently-thin.

Furthermore, as shown in FIG. 5D, the signal transmission line 16 is surrounded by the ground conductors (the first conductor 13, the second conductor 14, and the third conductor 17). This can diminish the radiated noise more than the cable connector 1A of the first embodiment, improving the transmission characteristics of signals. As a result, it is possible to route the wiring board 10B longer than that of the first embodiment. Therefore, the cable connector 1A or 1C according to the first embodiment or the third embodiment may be used in accordance with the size, the route length of the signal transmission line, and the desired radiated noise characteristics of the electronic equipment to be used.

Fourth Embodiment

Figure 8:
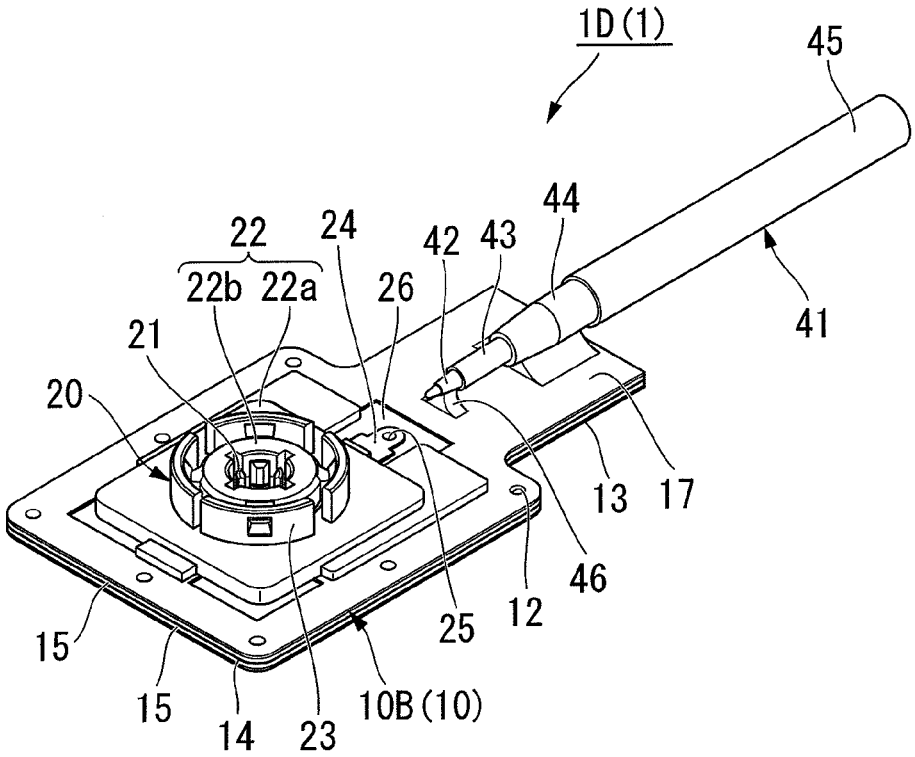
FIG. 8 is a schematic perspective view showing a fourth embodiment of the cable connector according to the present invention.

FIG. 8 is a perspective view showing a fourth embodiment of the cable connector according to the present invention.

A cable connector 1D (1) of the present embodiment is different from the aforementioned cable connector 1C (1) of the third embodiment in that a coaxial cable 41, which is electrically connected with a signal transmission line 16, is disposed on one surface of the third conductor 17 at one end portion of the wiring board 10B.

As the coaxial cable 41, one similar to that used in the second embodiment can be used. Also in the present embodiment, a central conductor 42 of the coaxial cable 41 is electrically connected with the signal transmission line 16 via a conducting member 46, and an external conductor 44 of the coaxial cable 41 is electrically connected with the third conductor 17. In the present embodiment, there is placed a conducting member 46 in a through-hole that penetrates the third conductor 17 and the insulating material 15 placed between the third conductor 17 and the second conductor 14. The conducting member 46 is similar to one in the second embodiment.

According to the cable connector 1D of the present embodiment, similar advantages to those of the aforementioned second embodiment are obtained. At this time, in the present embodiment, the connection portion between the plug connector 20 and the receptacle connector 33 is thicker than that of the first embodiment by the total thicknesses of the third conductor 13 and one layer of the insulating material 15 because the wiring board 10B comprises the first conductor 13, the second conductor 14, the third conductor 17, and the insulating materials 15 arranged therebetween. However, compared with the case where a conventional coaxial cable is used, the connection portion is still sufficiently-thin.

Furthermore, the signal transmission line 16 is surrounded by the ground conductors (the first conductor 13, the second conductor 14, and the third conductor 17). This can diminish the radiated noise more than the cable connector 1B of the second embodiment, improving the transmission characteristics of signals. As a result, it is possible to route the signal transmission line (the coaxial cable 41) longer than that of the second embodiment. Therefore, the cable connector 1B or 1D according to the second embodiment or the fourth embodiment may be used in accordance with the size, the route length of the signal transmission line, and the desired radiated noise characteristics of the electronic equipment to be used.

<Antenna Component>

Next is a description of embodiments of an antenna component according to the present invention.

The embodiments will be specifically described for better understanding of the spirit or scope of the invention, and hence, do not limit the present invention unless otherwise specified.

First Embodiment

Figure 9:
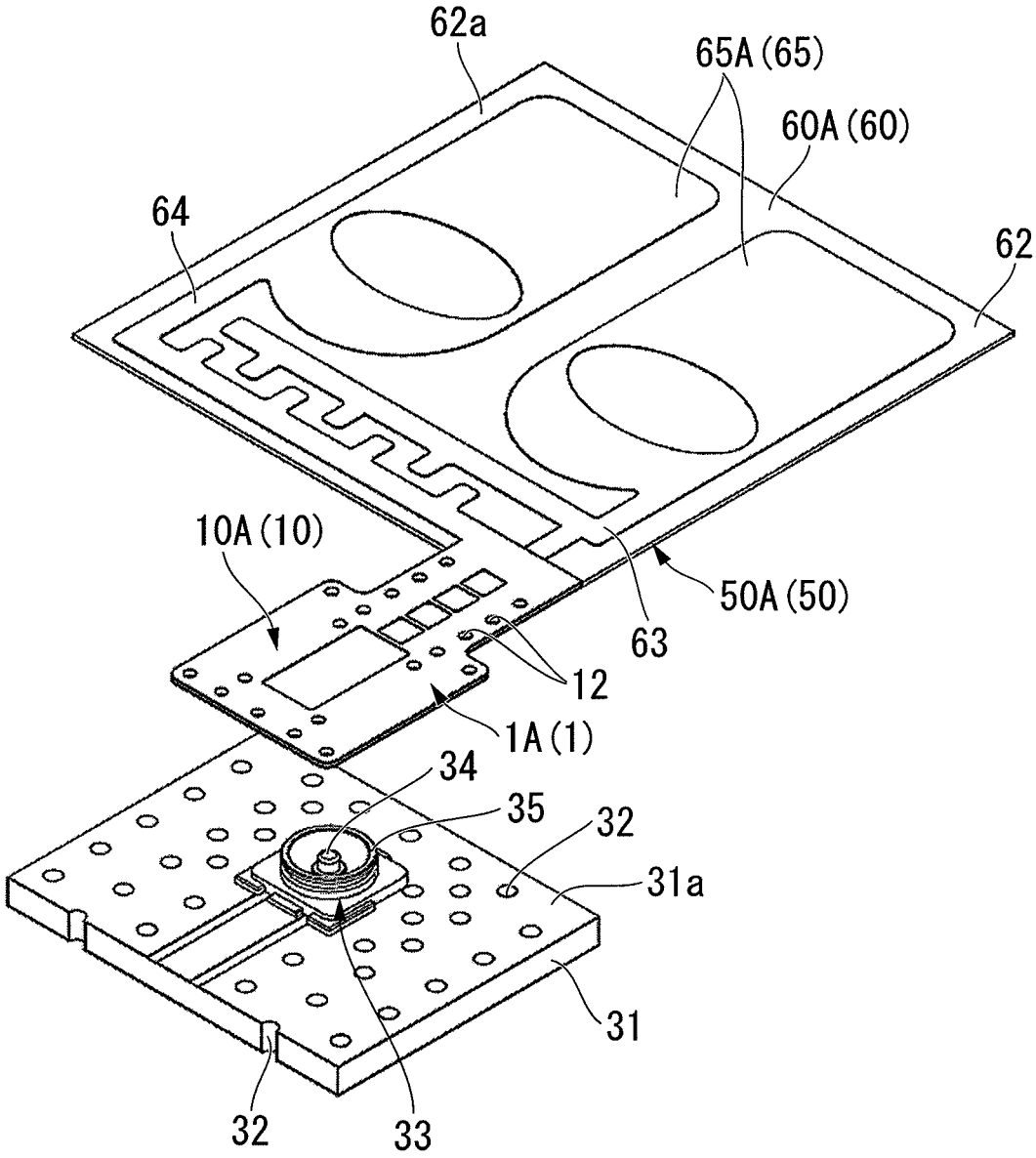
FIG. 9 is a perspective view of a first embodiment of an antenna component according to the present invention.

FIG. 9 is a schematic perspective view showing a first embodiment of an antenna component according to the present invention and how it is used.

An antenna component 50A (50) of the present embodiment comprises: the aforementioned cable connector 1A (the wiring board 10A and the plug connector 20) of the first embodiment; and a second wiring board 60A (60). Hereinafter, the wiring board 10A of the cable connector 1A is sometimes referred to as the first wiring board 10A.

The second wiring board 60 is coupled to the first wiring board 10A. On the second wiring board 60A, there is provided an antenna 65A (65) that is electrically connected with the signal transmission line 16 of the first wiring board 10A.

As for a plurality of through-holes 12 provided along the edge portion of the first wiring board 10A, a distance d therebetween is set to a length corresponding to ½ or less of the wavelength of the frequency of the antenna 65A.

The second wiring board 60A comprises: a flexible substrate 62; and the antenna 65A including an electric conductor 63 and a ground electric conductor 64, which are provided on one surface 62*a* of the substrate 62.

The electric conductor 63 is electrically connected with the signal transmission line 16 of the first wiring board 10A. The electric conductor 63 may be integrated with the signal transmission line 16.

The ground electric conductor 64 is electrically connected with the first conductor 13 of the first wiring board 10A. The ground electric conductor 64 may be integrated with the first conductor 13 as shown in FIG. 9.

As the substrate 62, a film-like or sheet-like resin made of: a polyimide resin, a polyethylene terephthalate resin, an aramid resin, or the like may be used.

As the electric conductor 63 and the ground electric conductor 64, a predetermined pattern formed on the one surface 62*a* of the substrate 62 may be used. Its formation methods include screen printing by use of a conductive paste, etching a conductive foil, and metal plating.

As the electrically conductive paste that forms the electric conductor 63 and the ground electric conductor 64, one in which conductive fine particles such as silver powder, gold powder, platinum powder, aluminum powder, palladium powder, rhodium powder, carbon powder (such as carbon black and carbon nanotubes) is blended with a resin composition may be used.

As the conductive foil that forms the electric conductor 63 and the ground electric conductor 64, a copper foil, a silver foil, a gold foil, a platinum foil, an aluminum foil, or the like may be used.

As the metal plating that forms the electric conductor 63 and the ground electric conductor 64, copper plating, silver plating, gold plating, platinum plating, or the like may be used.

As shown in FIG. 9, when used, the antenna component 50A of the present embodiment is connected with the receptacle connector 33, similarly to the aforementioned cable connector 1A. At this time, it is preferable that through-holes 32 be provided also in the substrate 31 on which the receptacle connector 33 is provided, in a manner spaced from each other by a distance corresponding to ½ or less of the wavelength of the frequency of the antenna 65A.

According to the antenna component 50A of the present embodiment, the first wiring board 10A is provided, instead of a conventional coaxial cable, for electrically connecting the antenna 65A with the plug connector 20. Therefore, the connection portion between the plug connector 20 and the receptacle connector 33 can be made thin, similarly to the case of the aforementioned cable connector 1A. Furthermore, the second wiring board 60A on which the antenna 65A is provided is coupled to the first wiring board 10A, and the antenna 65A is electrically connected with the signal transmission line 16. As a result, the connection portion between the first wiring board 10A and the second wiring board 60A is approximately as thick as the total thickness of the first wiring board 10A and the second wiring board 60A. Therefore, it is possible to make the connection portion between the antenna 65A and the first wiring board 10A significantly thinner than the connection portion between an coaxial cable and an antenna in the case where a conventional coaxial cable is used. In addition, the antenna 65A (the second wiring board 60A) itself is approximately as thick as the substrate 62, and hence, is also made thin. Taking this fact into consideration, electronic equipment can be made thin by mounting the antenna component 50A of the present embodiment on the electronic equipment.

Furthermore, in the antenna component 50A of the present embodiment, the aforementioned cable connector 1A is used. Therefore, as described above, impedance of the first wiring board 10A can be adjusted and the impedance can be optimized in accordance with the communication characteristics (frequency band, communication distance, and the like) at high frequencies of the antenna 65A of the second wiring board 60A. Consequently, it is possible to efficiently transmit electric power, and secure a sufficient communication distance.

Furthermore, it is possible to install the plug connector 20 on the first wiring board 10A with ease, that is, only an installation of the plug connector 20 on the FPC on which the antenna 65A is formed fabricates the antenna component 50A of the embodiment. Therefore, its assembly steps can be simplified, similarly to the case of the aforementioned cable connector 1A. As a result, special devices and jigs required for the assembly become unnecessary. Therefore, the manufacturing cost can be reduced. In addition, the manufactured antenna components 50A are unlikely to suffer from performance variations, making it possible to provide stable products.

Second Embodiment

Figure 10:
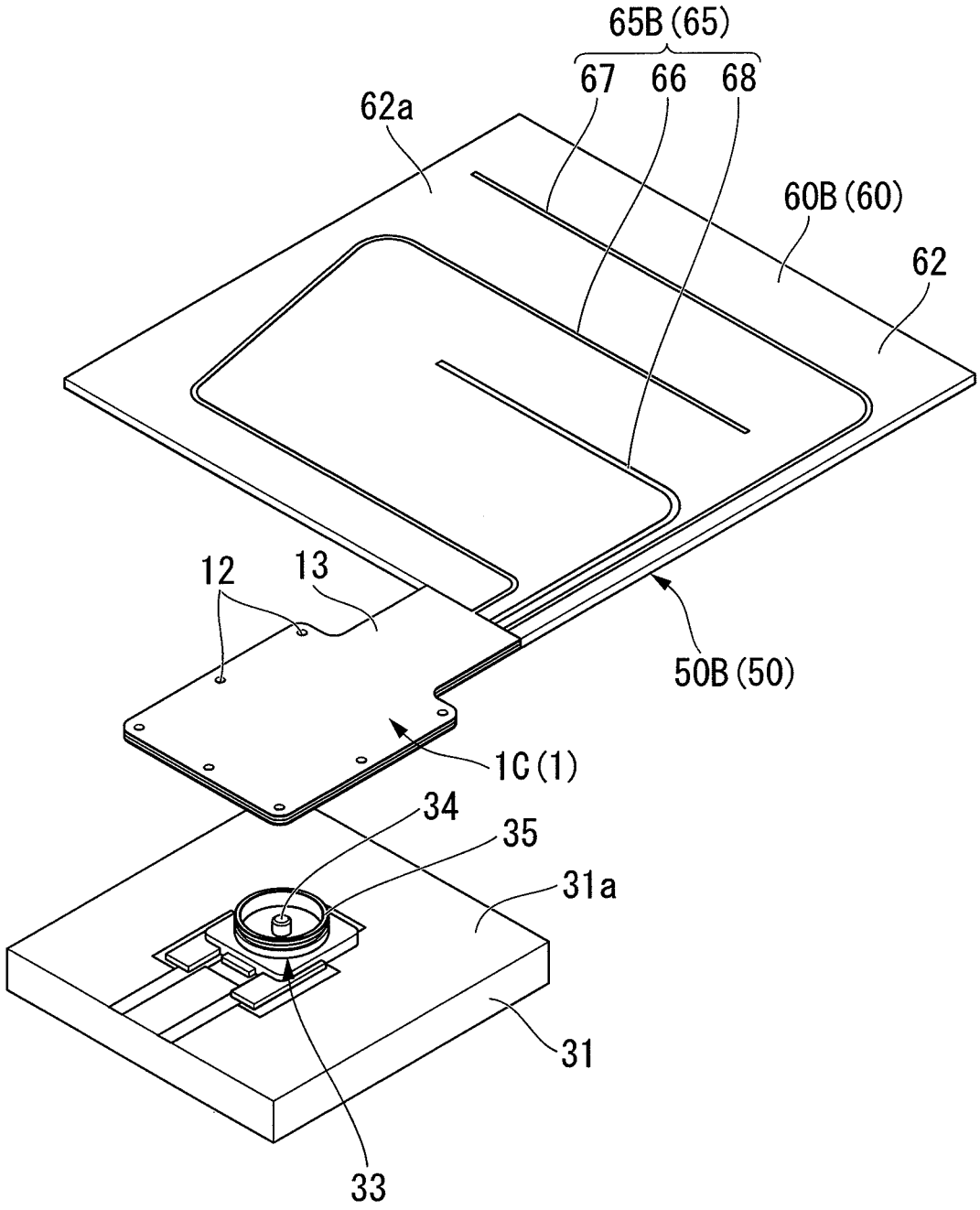
FIG. 10 is a perspective view showing a second embodiment of the antenna component according to the present invention.
Figure 11A:
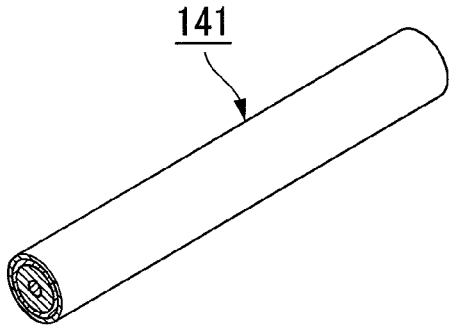
FIG. 11A is a process diagram showing how to electrically connect a coaxial cable with an RF module in the case where a conventional RF connector is used.
Figure 11B:
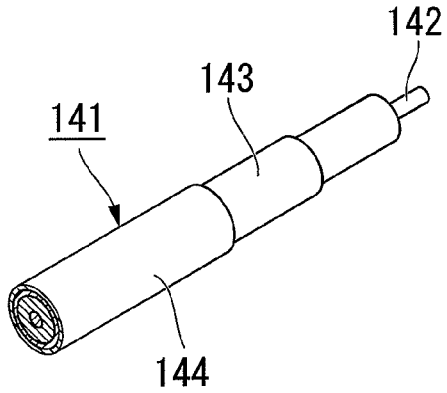
FIG. 11B is a process diagram showing how to electrically connect the coaxial cable with the RF module in the case where the conventional RF connector is used.
Figure 11C:
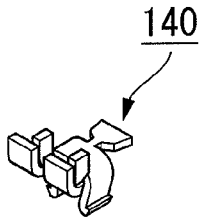
FIG. 11C is a process diagram showing how to electrically connect the coaxial cable with the RF module in the case where the conventional RF connector is used.
Figure 11D:
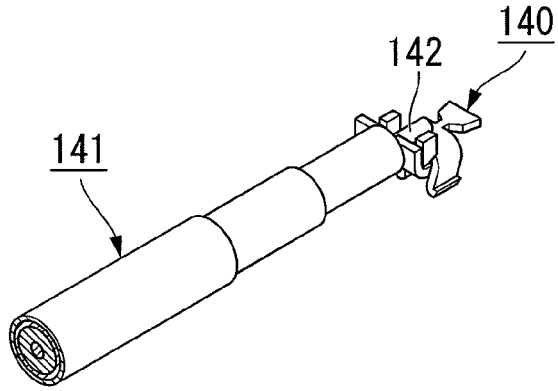
FIG. 11D is a process diagram showing how to electrically connect the coaxial cable with the RF module in the case where the conventional RF connector is used.
Figure 12A:
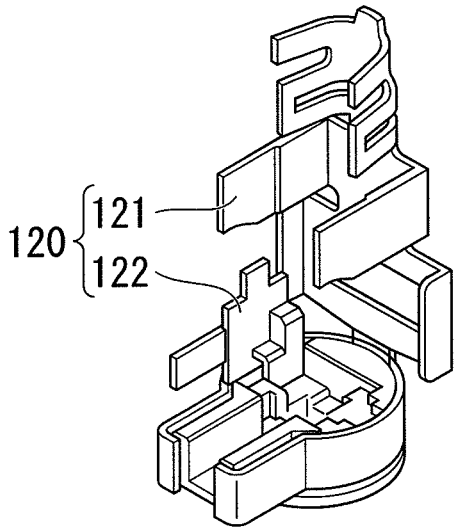
FIG. 12A is a process diagram showing how to electrically connect the coaxial cable with the RF module in the case where the conventional RF connector is used.
Figure 12B:
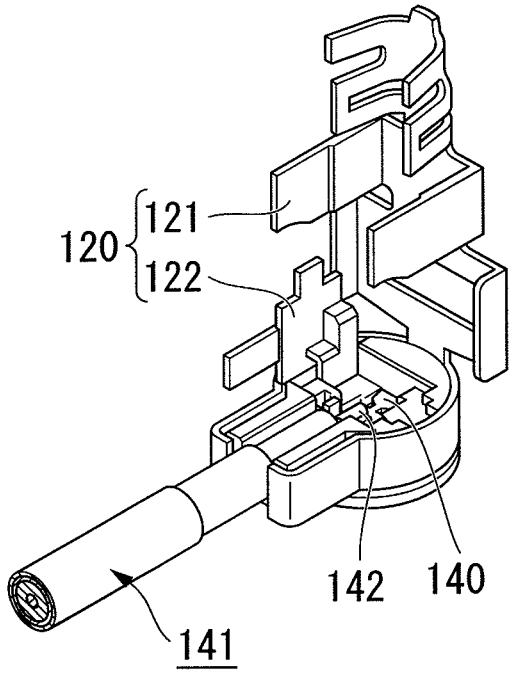
FIG. 12B is a process diagram showing how to electrically connect the coaxial cable with the RF module in the case where the conventional RF connector is used.
Figure 12C:
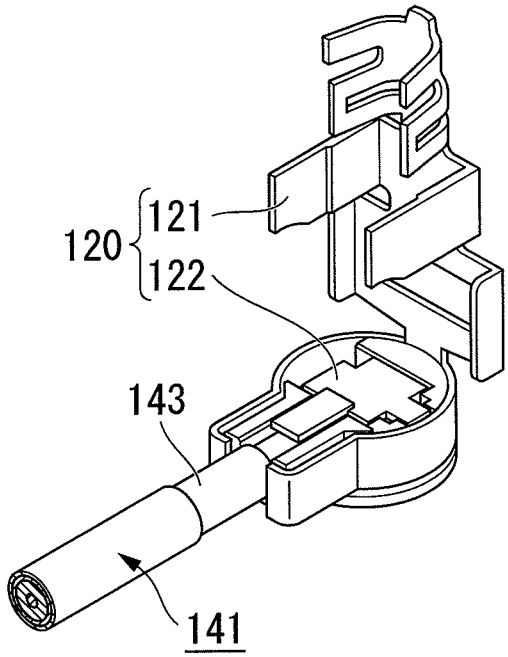
FIG. 12C is a process diagram showing how to electrically connect the coaxial cable with the RF module in the case where the conventional RF connector is used.
Figure 12D:
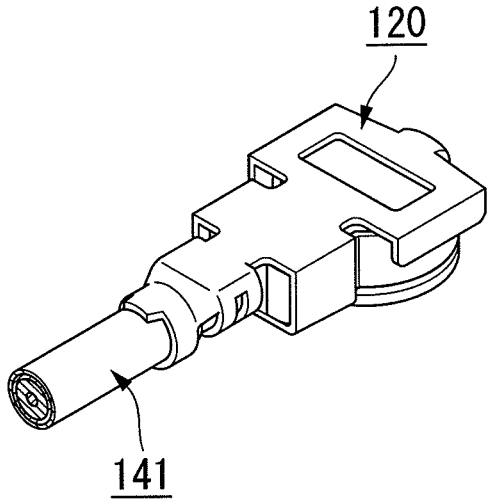
FIG. 12D is a process diagram showing how to electrically connect the coaxial cable with the RF module in the case where the conventional RF connector is used.
Figure 13:
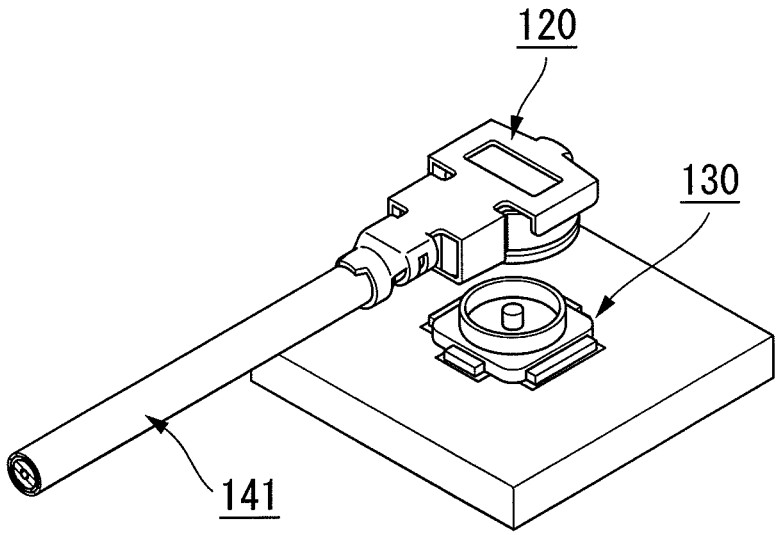
FIG. 13 is a process diagram showing how to electrically connect the coaxial cable with the RF module in the case where a conventional RF connector is used.

FIG. 10 is a schematic perspective view showing a second embodiment of the antenna component of the present invention and how to use it.

An antenna component 50B (50) of the present embodiment is different from the aforementioned antenna component 50A of the first embodiment in that a second wiring board 60B (60) is coupled to the aforementioned cable connector 1C (the wiring board 10B and the plug connector 20) according to the third embodiment and in that an antenna 65B (65) comprises: a first electric conductor 66; a second electric conductor 67; and a third electric conductor 68. Hereinafter, the wiring board 10B of the cable connector 1C is sometimes referred to as the first wiring board 10B.

The second wiring board 60B (60) of the present embodiment comprises: a flexible substrate 62; and the antenna 65B (65) including the first electric conductor 66, the second electric conductor 67, and the third electric conductor 68 that are provided on one surface 62*a* of the substrate 62.

Of these electric conductors, the first electric conductor 66 is electrically connected with the first conductor 13 of the first wiring board 10B, and functions as a ground conductor. On the other hand, the second electric conductor 67 and the third electric conductor 68 are electrically connected with the signal transmission line 16 of the first wiring board 10B. The length of the first electric conductor 66, the second electric conductor 67, and the third electric conductor 68 that constitute the antenna is set to a length corresponding to ¼ of the wavelength of the frequency of the electronic equipment in which the antenna component 50B of the present embodiment is used. The first electric conductor 66, the second electric conductor 67, and the third electric conductor 68 can be formed on the one surface 62*a* of the substrate 62, similarly to the electric conductor 63 and the ground electric conductor 64 which are used in the antenna component 50A of the first embodiment.

As shown in FIG. 10, when used, the antenna component 50B of the present embodiment is connected with the receptacle connector 33, similarly to the case of the aforementioned cable connector 1C. At this time, although not shown in FIG. 10, through-holes may be provided also in the substrate 31 on which the receptacle connector 33 is provided, in a manner spaced from each other by a distance corresponding to ½ or less of the wavelength of the frequency of the antenna 65B.

According to the antenna component 50B of the present embodiment, similar advantages to those of the aforementioned antenna component 50A of the first embodiment are obtained. At this time, in the present embodiment, the connection portion between the plug connector 20 and the receptacle connector 33, and the connection portion between the first wiring board 10B and the second wiring board 60B are thicker than that of the first embodiment by the total thickness of the third conductor 13 and one layer of the insulating material 15 because the wiring board 10B comprises the first conductor 13, the second conductor 14, the third conductor 17, and the insulating materials 15 arranged therebetween. However, compared with the case where a conventional coaxial cable is used, the connection portions are still sufficiently-thin.

Furthermore, the signal transmission line 16 is surrounded by the ground conductors (the first conductor 13, the second conductor 14, and the third conductor 17). This can diminish the radiated noise more than the antenna component 50B of the first embodiment, improving the transmission characteristics of signals. As a result, it is possible to route the signal transmission line (the first wiring board 10B) longer than that of the first embodiment.

Therefore, the antenna component 50A or 50B according to the first embodiment or the second embodiment may be applied in accordance with the size, the route length of the signal transmission line, and the desired radiated noise characteristics of the electronic equipment to be used.

According to the cable connector of the present invention, a connection portion between a plug connector and its mating connector can be made thin. Furthermore, the plug connector can be installed on a wiring board with ease, which makes it possible to simplify the assembly steps. As a result, the manufacturing cost of the cable connector can be reduced. Furthermore, because the assembly steps can be simplified, the manufactured cable connectors are unlikely to suffer from performance variations, making it possible to provide stable products. In addition, impedance of the wiring board can be optimized with ease in accordance with the communication characteristics (frequency band, communication distance, and the like) at high frequencies of the equipment and the antenna that are connected to the cable connector.

According to the antenna component of the present invention, the connection portion between the plug connector and the receptacle connector, and the connection portion between the first wiring board and the second wiring board can be made thinner than when a conventional coaxial cable is used. Furthermore, only an installation of the plug connector onto the FPC on which the antenna is formed fabricates the antenna component of the embodiment. Therefore, its assembly steps can be simplified. As a result, the manufacturing cost can be reduced, and the manufactured antenna components are unlikely to suffer from performance variations, making it possible to provide stable products. In addition, impedance of the first wiring board can be lowered, and also the impedance can be optimized in accordance with the communication characteristics (frequency band, communication distance, and the like) of the antenna at high frequencies. Therefore, according to the antenna component of the present invention, it is possible to efficiently transmit electric power, and secure a sufficient communication distance.

What is claimed is:

1. A cable connector comprising:

a wiring board having a signal transmission line; and a plug connector provided on one surface of the wiring board and electrically connected with the signal transmission line, wherein:

the wiring board comprises a first conductor, an insulating material, and a second conductor being laminated in this order;

in a slit formed in the second conductor, the signal transmission line that is a part of the second conductor cut out from the second conductor is arranged at a predetermined distance from the second conductor; and the second conductor and the signal transmission line are arranged on a same plane.

2. The cable connector according to claim 1, wherein the wiring board comprises the first conductor, the second conductor, and the third conductor laminated in this order respectively via an insulating material.

3. The cable connector according to claim 1, wherein on the one surface of the wiring board, a coaxial cable that is electrically connected with the signal transmission line is disposed.

4. The cable connector according to claim 2, wherein on the one surface of the wiring board, a coaxial cable that is electrically connected with the signal transmission line is disposed.

5. The cable connector according to claim 1, wherein a first notch portion is formed at a position facing the signal transmission line of the first conductor.

6. The cable connector according to claim 2, wherein a first notch portion is formed at a position facing the signal transmission line of the first conductor.

7. The cable connector according to claim 5, wherein a second notch portion is formed at a position facing the plug connector of the first conductor.

8. The cable connector according to claim 6, wherein a second notch portion is formed at a position facing the plug connector of the first conductor.

9. An antenna component comprising:

a first wiring board having a signal transmission line;

a plug connector provided on one surface of the first wiring board and electrically connected with the signal transmission line; and a second wiring board having an antenna electrically connected with the signal transmission line and coupled to the first wiring board, wherein:

the first wiring board comprises a first conductor, an insulating material, and a second conductor laminated in this order;

in a slit formed in the second conductor, the signal transmission line that is a part of the second conductor cut out from the second conductor is arranged at a predetermined distance from the second conductor; and the second conductor and the signal transmission line are arranged on a same plane.

10. The antenna component according to claim 9, wherein the first wiring board comprises the first conductor, the second conductor, and the third conductor being laminated respectively via an insulating material.

11. The antenna component according to claim 9, wherein a first notch portion is formed at a position facing the signal transmission line of the first conductor.

12. The antenna component according to claim 10, wherein a first notch portion is formed at a position facing the signal transmission line of the first conductor.

13. The antenna component according to claim 11, wherein a second notch portion is formed at a position facing the plug connector of the first conductor.

14. The antenna component according to claim 12, wherein a second notch portion is formed at a position facing the plug connector of the first conductor.

* * * * *